US007571813B2

(12) United States Patent
Weisskopf

(10) Patent No.: US 7,571,813 B2
(45) Date of Patent: Aug. 11, 2009

(54) FOLD BACK TOP PACKAGE

(75) Inventor: Jean-Marie Weisskopf, La Harengère (FR)

(73) Assignee: Eveready Battery Company, Inc., St. Louis, MO (US)

( * ) Notice: Subject to any disclaimer, the term of this patent is extended or adjusted under 35 U.S.C. 154(b) by 395 days.

(21) Appl. No.: 11/244,206

(22) Filed: Oct. 5, 2005

(65) Prior Publication Data

US 2007/0074995 A1 Apr. 5, 2007

(51) Int. Cl.
*B65D 85/00* (2006.01)

(52) U.S. Cl. ..... 206/755; 206/470; 206/705

(58) Field of Classification Search ..... 206/470, 206/703, 704, 705, 467, 471, 443, 751, 755, 206/759, 747, 745
See application file for complete search history.

(56) References Cited

U.S. PATENT DOCUMENTS

| | | | | |
|---|---|---|---|---|
| 1,552,177 | A | | 9/1925 | Prescott |
| 1,704,531 | A | | 3/1929 | Coombs |
| 2,617,578 | A | | 11/1952 | Fischer |
| 2,857,881 | A | | 10/1958 | Beebe et al. |
| 3,127,010 | A | | 3/1964 | Capezzuto |
| 3,581,885 | A | | 6/1971 | Wald |
| 4,062,486 | A | | 12/1977 | Goodrich |
| 4,106,621 | A | | 8/1978 | Sorenson |
| 4,119,203 | A | | 10/1978 | Kuchenbecker |
| 4,155,454 | A | | 5/1979 | Ryden |
| 4,223,788 | A | | 9/1980 | Jaeger et al. |
| 4,266,666 | A | | 5/1981 | Kuchenbecker |
| 4,412,616 | A | * | 11/1983 | Williams ..... 220/524 |
| 4,569,442 | A | | 2/1986 | Bushey |
| 4,938,462 | A | | 7/1990 | Gould |
| 5,052,557 | A | * | 10/1991 | Contino et al. ..... 206/427 |
| 5,067,611 | A | * | 11/1991 | Hagmann et al. ..... 206/383 |
| 5,154,293 | A | | 10/1992 | Gould |
| 5,443,202 | A | | 8/1995 | Jorgensen-Beck et al. |
| 5,584,389 | A | | 12/1996 | Focke et al. |

(Continued)

FOREIGN PATENT DOCUMENTS

DE 4121566 A1 1/1993

(Continued)

OTHER PUBLICATIONS

Reynolds Brand Marking Pen Package, [photograph #1] [photographed on Sep. 28, 2008].

(Continued)

*Primary Examiner*—Jacob K Ackun, Jr.
(74) *Attorney, Agent, or Firm*—Russell H. Toye, Jr.

(57) ABSTRACT

A battery package comprising a backing having a first area and a second area. The package also includes a first compartment extending from the first area of the backing, a second compartment extending from the second area of the backing, and batteries in the first compartment and the second compartment. The backing has a first position wherein the first compartment and the second compartment are closed and the batteries therein cannot be removed from the first compartment and the second compartment, with the first compartment closing the second compartment and the second compartment closing the first compartment. The backing has a second position wherein the first compartment and the second compartment are open and the batteries therein can be removed.

34 Claims, 8 Drawing Sheets

U.S. PATENT DOCUMENTS

| | | | | |
|---|---|---|---|---|
| 5,875,963 | A | 3/1999 | Stone et al. | |
| 5,921,384 | A | 7/1999 | Focke et al. | |
| 6,138,823 | A | 10/2000 | Focke et al. | |
| 6,279,746 | B1 | 8/2001 | Hussaini et al. | |
| 6,412,630 | B2 | 7/2002 | Focke et al. | |
| 6,471,123 | B1 | 10/2002 | Jensen | |
| 6,719,131 | B1 | 4/2004 | Focke et al. | |
| 2002/0112978 | A1* | 8/2002 | Hoch et al. | 206/380 |
| 2005/0082185 | A1 | 4/2005 | Lee | |
| 2006/0000738 | A1* | 1/2006 | Kumakura et al. | 206/470 |
| 2006/0096886 | A1* | 5/2006 | Morrison | 206/703 |
| 2006/0096887 | A1* | 5/2006 | Morrison | 206/703 |

FOREIGN PATENT DOCUMENTS

| | | | |
|---|---|---|---|
| EP | 1366997 | A2 | 12/2003 |
| EP | 1577224 | A1 | 9/2005 |
| FR | 1408886 | A | 8/1965 |

OTHER PUBLICATIONS

Reynolds Brand Marking Pen Package, [photograph #2] [photographed on Sep. 28, 2005].

Reynolds Brand Marking Pen Package, [photograph #3] [photographed on Sep. 28, 2005].

Reynolds Brand Marking Pen Package, [photograph #4] [photographed on Sep. 28, 2005].

* cited by examiner

FOLD BACK TOP PACKAGE

FIELD OF THE INVENTION

The present invention concerns packaging, and more particularly relates to packaging for batteries.

BACKGROUND OF THE INVENTION

Electrochemical cells (i.e., batteries) are commonly employed to supply voltage for electrically operated devices, particularly for portable electrically operated devices. Currently, a number of popular alkaline cells of the generally cylindrical shape are commercially available in industry-recognized, standard sizes, including D-, C-, AA- and AAA-size cells, as well as other sizes and configurations.

Heretofore, batteries have been shipped and displayed in stores in battery packages having a cardboard backing and a battery receptacle portion holding the batteries. The cardboard backing has been a single board or card. The single board is typically rectangular, with edges of the board being adjacent the periphery of the battery receptacle portion. Information about the manufacturer of the batteries and the typical devices for use with the batteries are typically located on the rear face of the board.

Another packaging for batteries has included lining up a row of batteries and shrink wrapping a plastic sleeve over the batteries. Sometimes, a card is positioned between the batteries and the plastic sleeve, wherein the card covers a front and a bottom of the row of batteries. Furthermore, some of these battery packages have more than one row of batteries. In order to access the batteries in the battery package in the sleeve, the sleeve is torn to allow the batteries to fall free. In order to assist in removing the batteries from the sleeved package, the sleeve sometimes has perforations such that portions of the sleeve are easily torn.

Accordingly, an improved battery package is desired.

SUMMARY OF THE INVENTION

One aspect of the present invention is to provide a battery package comprising a backing having a first area and a second area. The package also includes a first compartment extending from the first area of the backing, a second compartment extending from the second area of the backing, and batteries in the first compartment and the second compartment. The backing has a first position wherein the first compartment and the second compartment are closed and the batteries therein cannot be removed from the first compartment and the second compartment, with the first compartment closing the second compartment and the second compartment closing the first compartment. The backing has a second position wherein the first compartment and the second compartment are open and the batteries therein can be removed.

Another aspect of the present invention is to provide a package comprising a backing having a first area and a second area, a first compartment extending from the first area of the backing and holding a first product therein, and a second compartment extending from the second area of the backing and holding a second product therein. The backing has a first position wherein the first compartment and the second compartment are closed and the products therein can not be removed from the first compartment and the second compartment, with the first compartment closing the second compartment and the second compartment closing the first compartment. The backing has a second position wherein the first compartment and the second compartment are open and the products therein can be removed. The first compartment includes a latch mechanism for latching the first compartment onto the second compartment to maintain the backing in the first position.

Yet another aspect of the present invention is to provide a package comprising a backing, a first compartment extending from the backing and configured to hold a first product therein, and a second compartment extending from the backing and configured to hold a second product therein. The backing has a first position wherein the first compartment and the second compartment are closed and the products therein cannot be removed from the first compartment and the second compartment, with the first compartment closing the second compartment and the second compartment closing the first compartment. The backing has a second position wherein the first compartment and the second compartment are open and the products therein can be removed. The first compartment is separate from the second compartment when the first compartment and the second compartment are open.

These and other features, advantages, and objects of the present invention will be further understood and appreciated by those skilled in the art by reference to the following specification, claims and appended drawings.

DETAILED DESCRIPTION OF THE PREFERRED EMBODIMENTS

Figure 1:
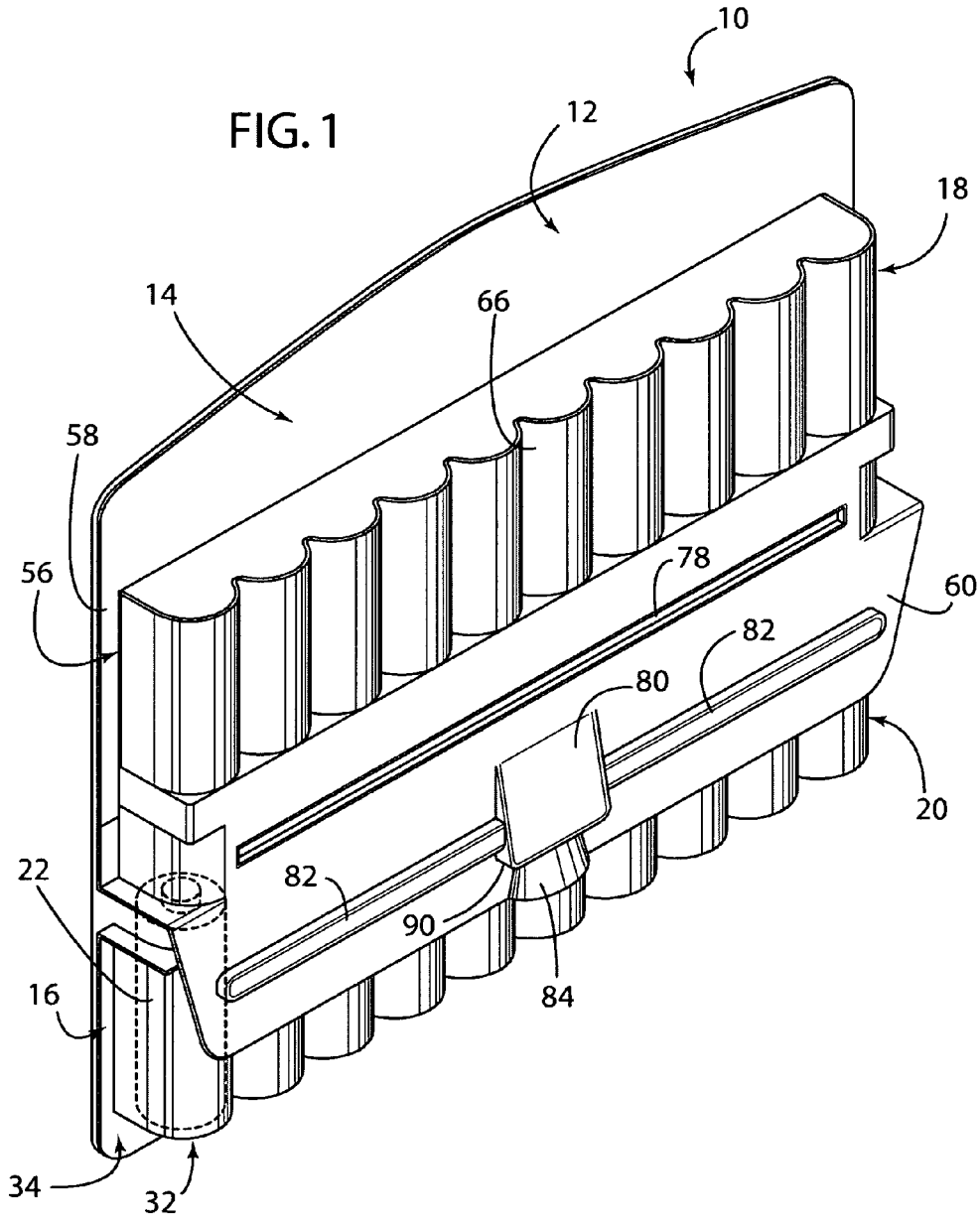
FIG. 1 is an isometric view of a battery package of the present invention.
Figure 2:
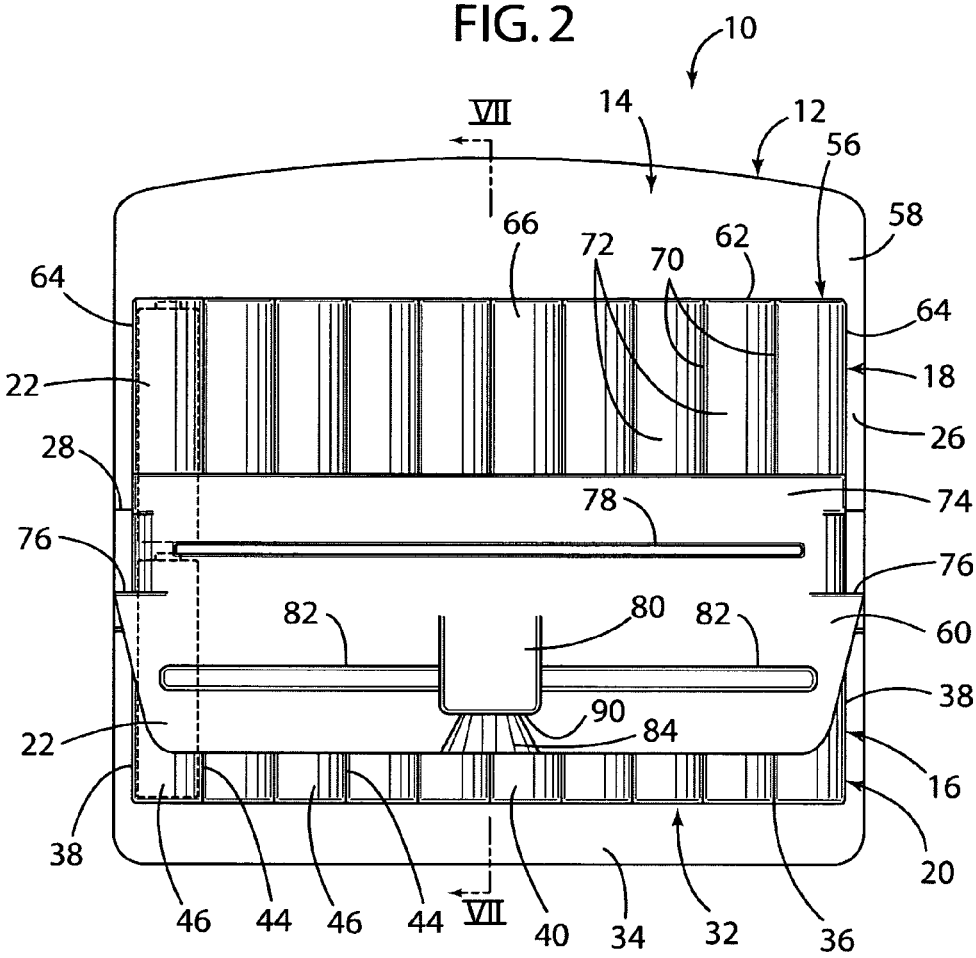
FIG. 2 is a front view of the battery package of the present invention in a closed position.
Figure 4:
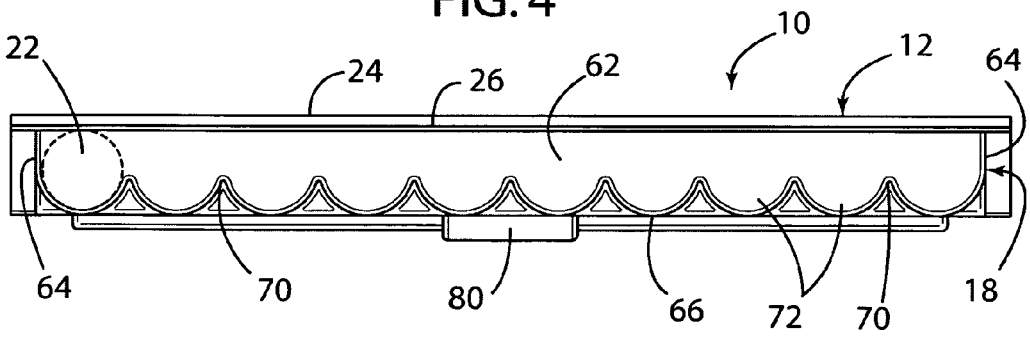
FIG. 4 is a top view of the battery package of the present invention in the closed position.
Figure 3:
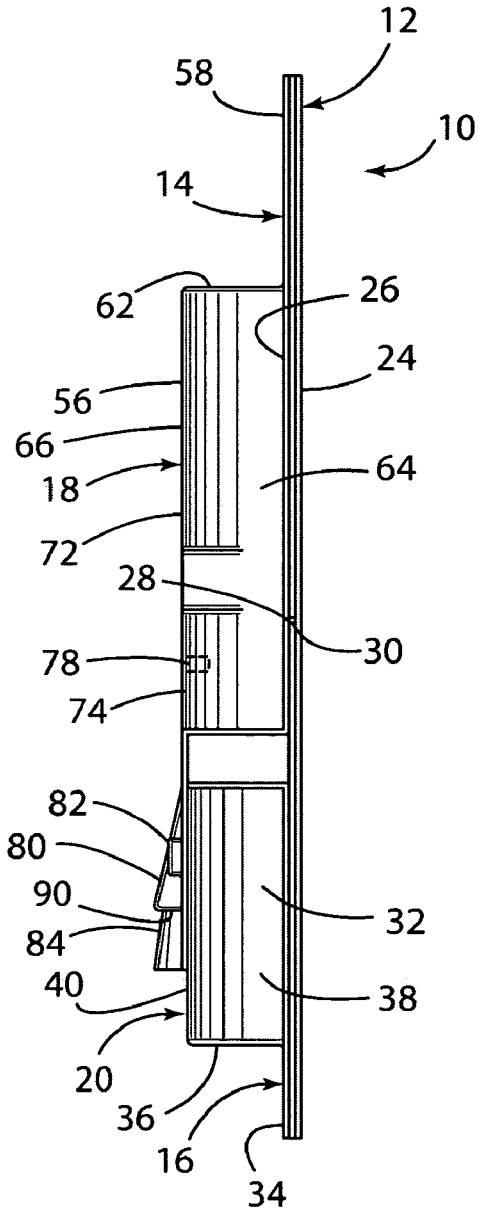
FIG. 3 is a side view of the battery package of the present invention in the closed position.
Figure 7:
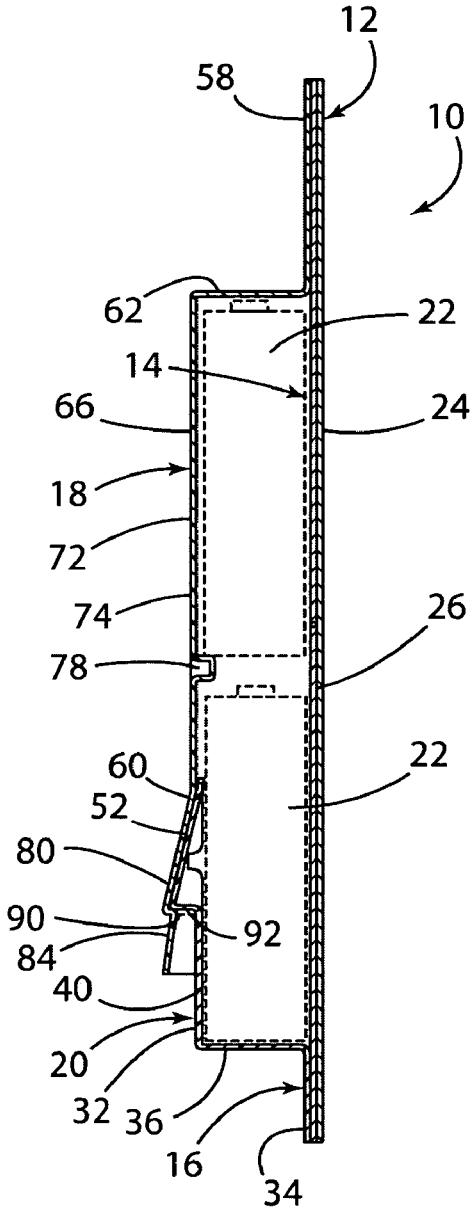
FIG. 7 is a cross-sectional view of the battery package of the present invention taken along the line VII-VII of FIG. 2.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a battery package of the present invention. The battery package 10 comprises a backing 12 having a first area 14 and a second area 16. The package 10 also includes a first compartment 18 extending from the first area 14 of the backing 12, a second compartment 20 extending from the second area 16 of the backing 12, and batteries 22 in the first compartment 18 and the second compartment 20. The backing 12 has a first position (see FIGS. 1-4) wherein the first compartment 18 and the second compartment 20 are closed and the batteries 22 therein cannot be removed from the first compartment 18 and the second compartment 20, with the first compartment 18 closing the second compartment 20 and the second compartment 20 closing the first compartment 18. The backing 12 has a second position (see FIGS. 5 and 6) wherein the first compartment 18 and the second compartment 20 are open and the batteries 22 therein can be removed.

In the illustrated embodiment, the battery package 10 is configured to have the batteries 22 placed therein. The batteries 22 can be any of a number of popular alkaline cells of the generally cylindrical shape commercially available in industry-recognized, standard sizes, including D-, C-, AA-, AAA-, and AAAA-size cells. Furthermore, the batteries can be other sizes and configurations (e.g., block shaped 9 volt batteries), and the batteries in each compartment could be of various sizes, configuration or orientations (e.g., AA-size cells in the first compartment and AAA-size cells in the second compartment, AA-size cells and AAA-size cells both in the first compartment, etc.). Moreover, it is contemplated that instead of batteries, the package 10 can hold any object having a cylindrical shape or any other shape therein.

Figure 5:
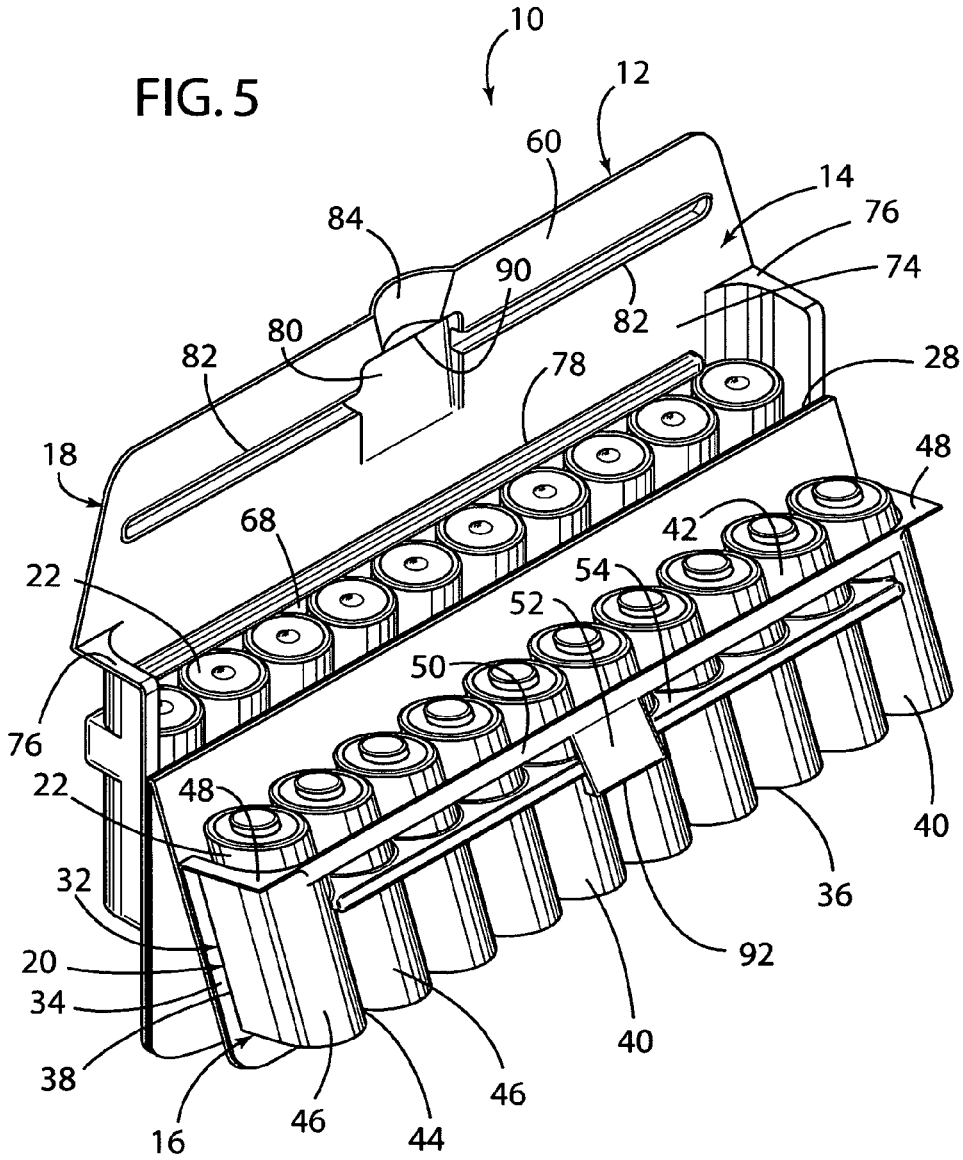
FIG. 5 is a front isometric view of the battery package of the present invention in an open position.
Figure 5A:
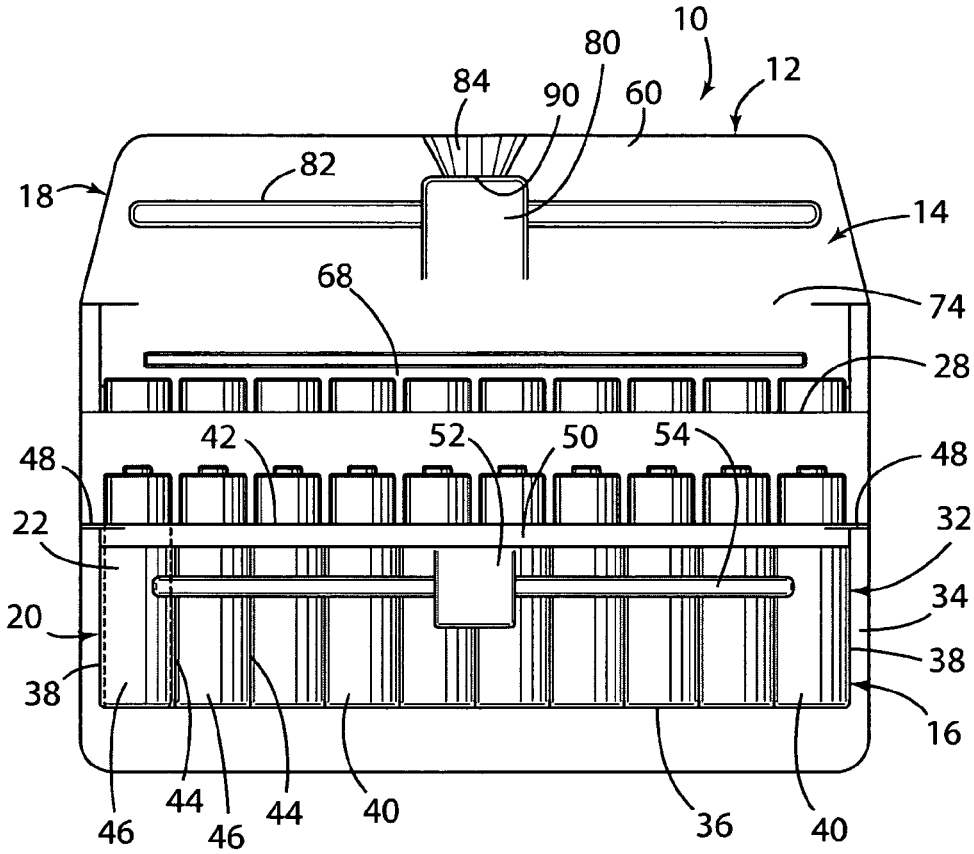
FIG. 5A is a front view of the battery package of the present invention in the open position.
Figure 6:
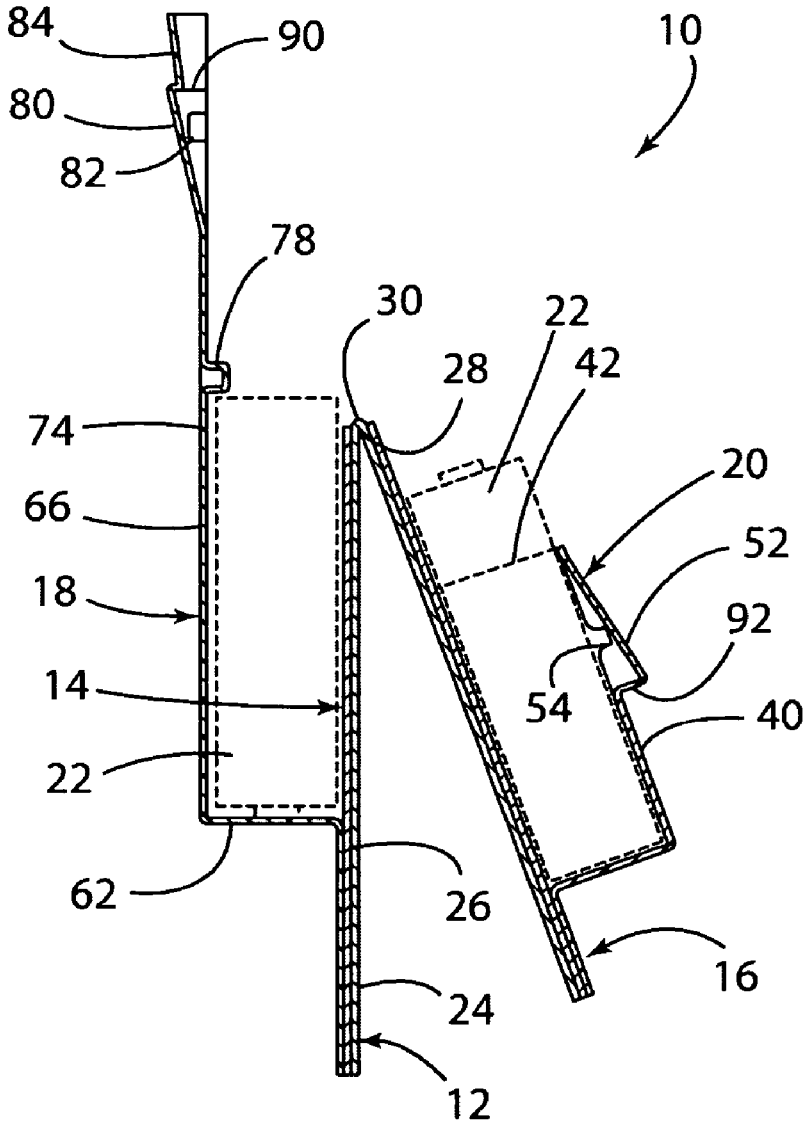
FIG. 6 is a side view of the battery package of the present invention in the open position.

The illustrated battery package 10 includes the backing 12 having the first compartment 18 and the second compartment 20 thereon. The backing 12 is preferably made of a couple of thin layers of cardboard material comprising a rear board 24 and a front board 26. The backing 12 includes the first area 14 and the second area 16. In the illustrated embodiment, the first area 14 and the second area 16 are separated by a fold line 28. The fold line 28 can include a cut out area 30 between the first area 14 and the second area 16 on the front board 26, thereby allowing the backing 12 to be folded by moving the first area 14 of the rear board 24 towards the second area 16 of the rear board 24 as illustrated in FIGS. 5 and 6. It is contemplated, however, that the backing 12 can comprise only one board and/or can include a perforated area at the fold line 28 for allowing the backing to be folded and/or torn apart or can be made of any material. Furthermore, the backing 12 can include an opening for inserting a hanger through the opening for hanging and displaying the battery package 10 or other hanging means.

In the illustrated embodiment, the second compartment 20 is located on the second area 16 of the backing 12 and includes the batteries 22 therein. The second compartment 20 comprises a battery holding portion 32 and a rim 34 extending from a bottom and sides of the battery holding portion 32. The rim 34 is configured to be adhered to the front board 26 of the backing 12 at the second area 16. The battery holding portion 32 includes a front face 40 spaced from the front board 26 and the batteries 22 are configured to be positioned between the front board 26 and the front face 40 of the battery holding portion 32. The battery holding portion 32 preferably includes a bottom wall 36, a pair of side walls 38, the front face 40 and an open top 42. The batteries 22 are configured to be dispensed out of the open top 42 of the battery holding portion 32. The front face 40 of the battery holding portion 32 includes a plurality of battery holding grooves 44 defining a plurality of single battery holding areas 46. Each single battery holding area 46 preferably includes an arcuate surface for maintaining a cylindrical battery 22 therein. However, it is contemplated that the front face 40 could not include the battery holding grooves 44 such that the batteries 22 in the second compartment 20 can move therein. Furthermore, if the batteries 22 or other products in the second compartment 20 are not cylindrical, the battery holding area 46 could have another surface (e.g., flat for 9 volt batteries). Moreover, a top of the front face 40 of the battery holding portion 32 includes a flat top area 50. The second compartment 20 also includes a pair of ledges 48 extending from a top of the side walls 38 of the battery holding portion 32 and extending forwardly from the rim 34. However, it is contemplated that the second compartment 20 does not have to include the pair of ledges 48. As described in more detail below, the front face 40 of the battery holding portion 32 further includes a ramped inner latch 52 for assisting in maintaining the backing 12 in the first position and a pair of co-linear inner ridges 54 extending from sides of the ramped inner latch 52 for providing stability to the compartment 16.

The illustrated first compartment 18 is located on the first area 14 of the backing 12 and includes the batteries 22 therein. The first compartment 18 comprises a battery holding portion 56, a rim 58 extending from a top and sides of the battery holding portion 56 and a flap 60. The rim 58 is configured to be adhered to the front board 26 of the backing 12 at the first area 14. The battery holding portion 56 includes a front face 66 spaced from the front board 26 and the batteries 22 are configured to be positioned between the front board 26 and the front face 66 of the battery holding portion 56. The battery holding portion 56 preferably includes a top wall 62, a pair of side walls 64, the front face 66 and an open bottom 68. The batteries 22 are configured to be dispensed out of the open bottom 68 of the battery holding portion 56. The front face 66 of the battery holding portion 56 includes a plurality of battery holding grooves 70 defining a plurality of single battery holding areas 72. Each single battery holding area 72 preferably includes an arcuate surface for maintaining a cylindrical battery 22 therein. However, it is contemplated that the front face 66 could not include the battery holding grooves 70 such that the batteries 22 in the first compartment 18 can move therein. Furthermore, if the batteries 22 or other products in the first compartment 18 are not cylindrical, the battery holding area 72 could have another surface (e.g., flat for 9 volt batteries). Moreover, a bottom of the front face 66 of the battery holding portion 56 includes a flat bottom area 74. The flat bottom area 74 includes an inwardly extending trough 78 that is located under the batteries 22 when the batteries 22 are placed in the first compartment 18. The first compartment 18 also includes a pair of ledges 76 extending from a bottom of the side walls 64 of the battery holding portion 56 and extending forwardly from the rim 58.

In the illustrated example, the flap 60 of the first compartment 18 covers a top of the batteries 22 in the second compartment 20 when the backing 12 is in the first position and is used to close the battery package 10. The flap 60 extends from the flat bottom area 74 of the battery holding portion 56 and includes a ramped outer latch 80, a pair of co-linear outer ridges 82 extending from sides of the ramped outer latch 80, and an arcuate opening tab 84 located at an end of the ramped outer latch 80. The flap 60 covers the top of the second compartment 20 and the ramped outer latch 80 covers and engages the ramped inner latch 52 to maintain the backing 12 in the first position.

The illustrated battery package 10 is used to transport and hold batteries 22 when they are purchased and after purchase. Initially, the battery package 10 is filled with batteries 22 by placing the batteries 22 in the first compartment 18 and the second compartment 20. The batteries 22 are placed into the battery package 10 by moving the backing 12 to the second position such that backing 12 is folded along the fold line 28 and the battery package 10 is open. Preferably, the batteries 22 are positioned in the first compartment 18 and the second compartment 20 such that a plurality of batteries 22 are positioned parallel to each other in each compartment. Furthermore, a single battery 22 is preferably located behind each battery holding area 46, 72 and the batteries 22 are separated by the battery holding grooves 44, 70. Thereafter, the first area 14 of the backing 12 is rotated to be co-linear with the second area 16 of the backing 12. In this configuration, each battery 22 in the first compartment 18 is co-linear with a battery 22 in the second compartment 20. Furthermore, the inwardly extending trough 78 on the flat bottom area 74 at the bottom of the front face 66 of the battery holding portion 56 will be located approximately between a bottom of the batteries 22 in the first compartment 18 and a top of the batteries 22 in the second compartment 20.

In the illustrated embodiment, the ramped outer latch 80 of the first compartment 18 covers and engages the ramped inner latch 52 of the second compartment 20 to maintain the backing 12 in the first position and the battery package 10 closed. Therefore, when the backing 12 is moved from the first position to the second position as described above, the ramped outer latch 80 will cover the ramped inner latch 52 and a bottom lip 90 of the ramped outer latch 80 will engage a bottom lip 92 of the ramped inner latch 52 to prevent rotation of the first area 14 of the backing 12 relative to the second area 16 and thereby maintain the backing 12 in the first position. Furthermore, the pair of co-linear inner ridges 54 on the front face 40 of the battery holding portion 32 of the second compartment 20 will be inserted into the pair of co-linear outer ridges 82 extending from sides of the ramped outer latch 80 on the flap 60 of the first compartment 18. Therefore, the first compartment 18 will close the second compartment 20 and the second compartment 20 will close the first compartment 18. When sold, the battery package 10 can have a shrink wrap placed thereon or have a piece of tape or similar material covering both the flap 60 and a portion of the second compartment 20 to prevent opening of the battery package 10 until the shrink wrap or tape is removed. It is contemplated that other means of holding the battery package 10 closed and other latch mechanisms could also be used.

To open the battery package 10 to obtain access to the batteries 22 therein, the shrink wrap, tape or other material (if used) is removed and an item or finger can be inserted into the arcuate opening tab 84 to pull the ramped outer latch 80 away from the ramped inner latch 52, thereby allowing the first area 14 of the backing 12 to be rotated relative to the second area 16 of the backing 12. The batteries 22 are then accessible and can be removed from the battery package 10. To close the battery package 10 and keep the remaining batteries therein 10, the first area 14 of the backing 12 is rotated to be parallel to the second area 16 of the backing 12 and the ramped outer latch 80 can once again be positioned over the ramped inner latch 52. Therefore, the battery package 10 can be used multiple times to hold batteries 22. Furthermore, it is contemplated that the first area 14 of the backing 12 can be removed from the second area 16 of the backing 12 by tearing the backing 12 along the fold line 28, thereby providing a separate first compartment 18 with batteries 22 and a separate second compartment 20 with batteries 22.

Figure 8:
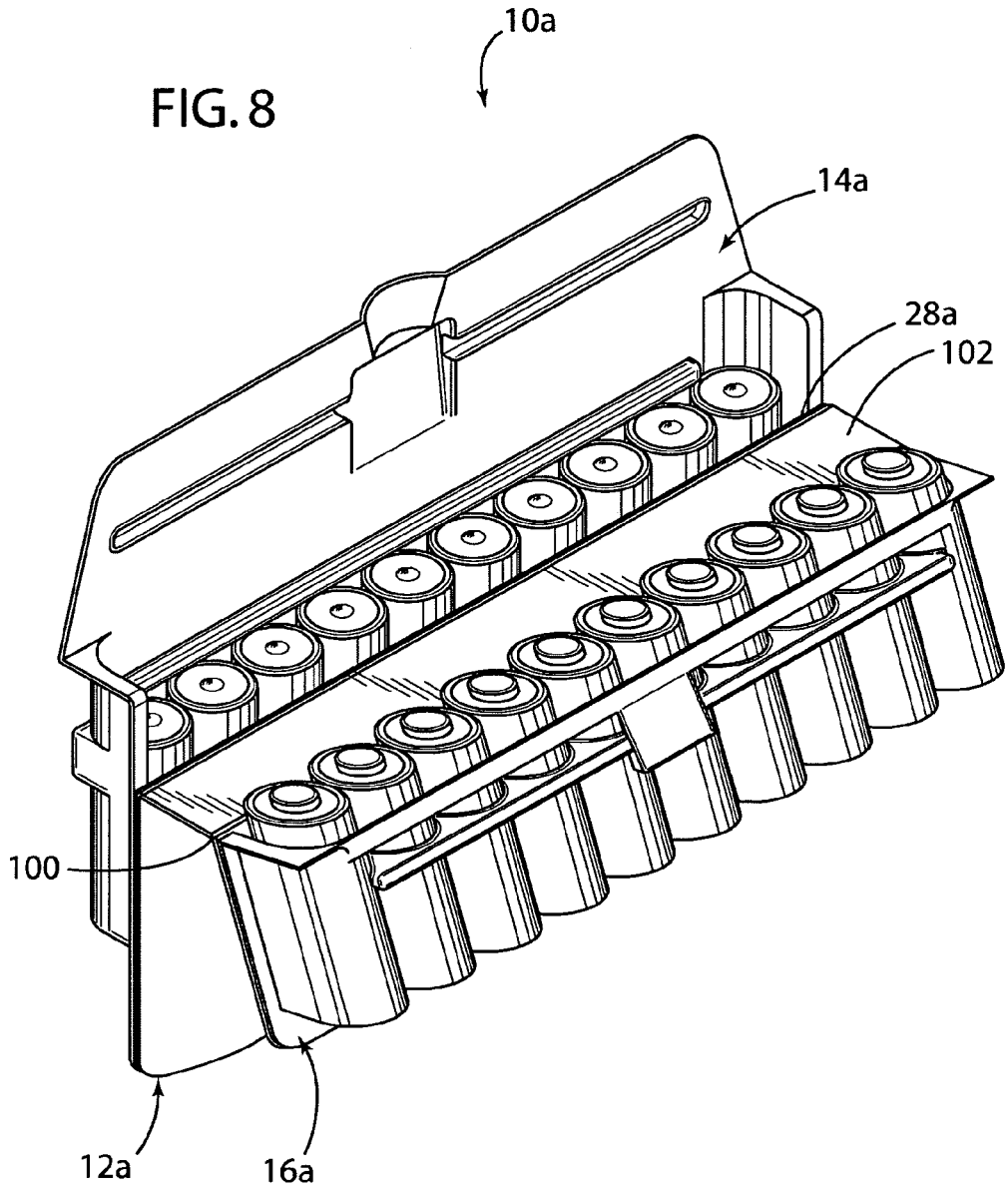
FIG. 8 is a front isometric view of a second embodiment of the battery package of the present invention in an open position.
Figure 9:
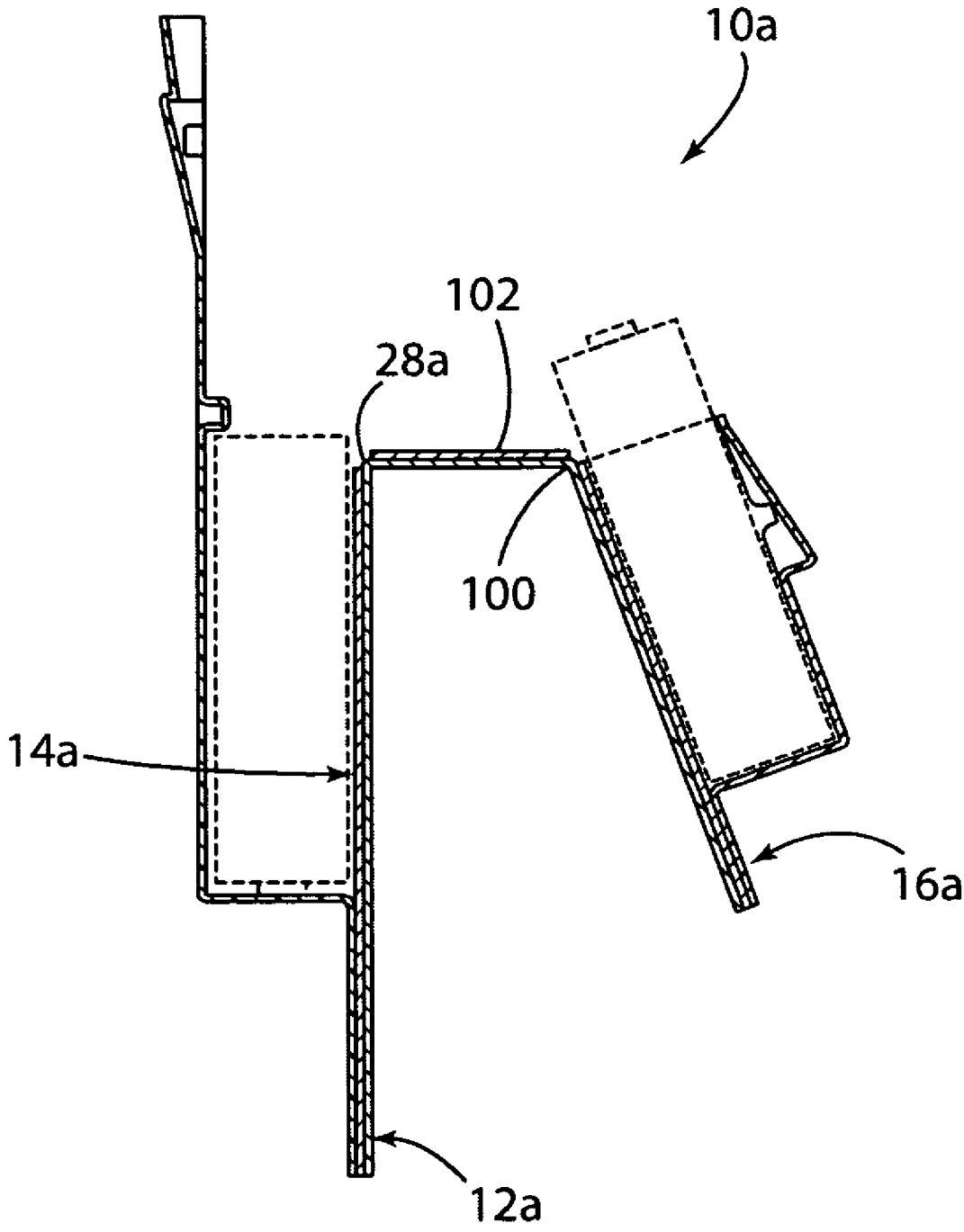
FIG. 9 is a cross-sectional view of the second embodiment of the battery package of the present invention in the open position.

The reference numeral 10*a* (FIGS. 8-9) generally designates another embodiment of the present invention, having a second embodiment for the battery package. Since battery package 10*a* is similar to the previously described battery package, similar parts appearing in FIGS. 1-7 and FIGS. 8-9, respectively, are represented by the same, corresponding reference number, except for the suffix "a" in the numerals of the latter. The battery package 10*a* is identical to the first embodiment of the battery package 10, except that the backing 12*a* of the battery package 10*a* includes a second fold line 100 located between the fold line 28*a* and the second area 16*a*. Therefore, the backing 12*a* includes the first area 14*a*, the second area 16*a* and a spanning area 102 located between the first area 14*a* and the second area 16*a*. The second fold line 100 allows the battery package 10*a* to be folded in an inverted U-shaped as illustrated in FIG. 8.

The above description is considered that of the preferred embodiments only. Modifications of the invention will occur to those skilled in the art and to those who make or use the invention. For example, it is contemplated that the backing 12 could include more than two compartments. Accordingly, it is contemplated that the backing 12 could have three compartments with the middle compartment having a pair of oppositely facing flaps with each flap configured to cover one compartment and the board being configured to have two fold lines. In this situation, the middle compartment could have two open ends or only one open end. Furthermore, the battery package 10 could include four compartments, with the two inner compartments having flaps or the two outer compartments having flaps. Moreover, any number of compartments could be used. Therefore, it is understood that the embodiments shown in the drawings and described above are merely for illustrative purposes and not intended to limit the scope of the invention.

Moreover, the foregoing detailed description is considered that of a preferred embodiment only, and the particular shape and nature of at least some of the components in this embodiment are at least partially based on manufacturing advantages and considerations as well as on those pertaining to assembly and operation. Modifications of this embodiment may well occur to those skilled in the art and to those who make or use the invention after learning the nature of this preferred embodiment, and the invention lends itself advantageously to such modification and alternative embodiments. Therefore, it is to be understood that the embodiment shown in the drawings and described above is provided principally for illustrative purposes and should not be used to limit the scope of the invention.

What is claimed is:

1. A battery package comprising:

a backing having a first area and a second area;

a first compartment extending from the first area of the backing;

a second compartment extending from the second area of the backing; and batteries in the first compartment and the second compartment;

the backing having a first position wherein the first compartment and the second compartment are closed and the batteries therein cannot be removed from the first compartment and the second compartment, with the first compartment closing the second compartment and the second compartment closing the first compartment;

the backing having a second position wherein the first compartment and the second compartment are open and the batteries therein can be removed;

wherein the batteries include a cylindrical housing and have a first end, a second end and an axis along a center of the cylindrical housing; and wherein a first one of the batteries in the first compartment has its axis co-linear with the axis of a second one of the batteries in the second compartment when the backing is in the first position.

2. The battery package of claim 1, wherein:

the first compartment includes a latch mechanism for latching the first compartment onto the second compartment to maintain the backing in the first position.

3. The battery package of claim 2, wherein:

the first compartment includes a battery holding portion and a flap extending from the battery holding portion, the flap including the latch mechanism thereon.

4. The battery package of claim 2, wherein:

the second compartment includes a latch receiving mechanism for engaging the latch mechanism of the first compartment for latching the first compartment onto the second compartment to maintain the backing in the first position.

5. The battery package of claim 4, wherein:

the first compartment includes an opening tab for easily disengaging the latch mechanism from the latch receiving mechanism.

6. The battery package of claim 1, wherein:

the first compartment is separate from the second compartment when the first compartment and the second compartment are open.

7. The battery package of claim 1, wherein:

the backing includes at least one fold line dividing the backing into the first area and the second area.

8. The battery package of claim 7, wherein:

the at least one fold line comprises two fold lines, the backing further including a spanning area between the first area and the second area.

9. The battery package of claim 1, wherein:

the first compartment includes a wall having a plurality of arcuate portions, each arcuate portion abutting a side wall of the cylindrical housings of the batteries in the first compartment.

10. The battery package of claim 9, wherein:

the second compartment includes a wall having a plurality of arcuate portions, each arcuate portion of the wall of the second compartment abutting a side wall of the cylindrical housings of the batteries in the second compartment.

11. The battery package of claim 1, wherein:

the backing comprises a flat panel when in the first position, with the flat panel having a first face and an opposite second face; and the first compartment and the second compartment extend from the first face.

12. The battery package of claim 1, wherein:

the batteries are in each of the first compartment and the second compartment when the backing is in both the first position and the second position.

13. A package comprising:

a backing having a first area and a second area;

a first compartment extending from the first area of the backing and holding first batteries therein; and a second compartment extending from the second area of the backing and holding second batteries therein;

the backing having a first position wherein the first compartment and the second compartment are closed and the batteries therein cannot be removed from the first compartment and the second compartment, with the first compartment closing the second compartment and the second compartment closing the first compartment;

the backing having a second position wherein the first compartment and the second compartment are open and the batteries therein can be removed;

the first compartment including a latch mechanism for latching the first compartment onto the second compartment to maintain the backing in the first position;

wherein the batteries include a cylindrical housing and have a first end, a second end and an axis along a center of the cylindrical housing; and wherein the a first one of the first batteries in the first compartment has its axis co-linear with the axis of a second one of the second batteries in the second compartment when the backing is in the first position.

14. The package of claim 13, wherein:

the first compartment includes a holding portion and a flap extending from the holding portion, the flap including the latch mechanism thereon.

15. The package of claim 13, wherein:

the second compartment includes a latch receiving mechanism for engaging the latch mechanism of the first compartment for latching the first compartment onto the second compartment to maintain the backing in the first position.

16. The package of claim 15, wherein:

the first compartment includes an opening tab for easily disengaging the latch mechanism from the latch receiving mechanism.

17. The package of claim 13, wherein:

the first compartment is separate from the second compartment when the first compartment and the second compartment are open.

18. The package of claim 13, wherein:

the backing includes at least one fold line dividing the backing into the first area and the second area.

19. The package of claim 18, wherein:

the at least one fold line comprises two fold lines, the backing further including a spanning area between the first area and the second area.

20. The package of claim 13, wherein:

the latch mechanism releasibly latches the first compartment onto the second compartment to maintain the backing in the first position.

21. The package of claim 20, wherein:

the backing comprises a flat panel when in the first position, with the flat panel having a first face and an opposite second face; and the first compartment and the second compartment extend from the first face.

22. The package of claim 13, wherein:

the first compartment includes a wall having a plurality of arcuate portions, each arcuate portion abutting a side wall of the first batteries in the first compartment.

23. The package of claim 22, wherein:

the second compartment includes a wall having a plurality of arcuate portions, each arcuate portion of the wall of the second compartment abutting a side wall of the second batteries in the second compartment.

24. A package comprising:

a backing;

a first compartment extending from the backing and holding first batteries therein; and a second compartment extending from the backing and holding second batteries therein;

the backing having a first position wherein the first compartment and the second compartment are closed and the batteries therein cannot be removed from the first compartment and the second compartment, with the first compartment closing the second compartment and the second compartment closing the first compartment;

the backing having a second position wherein the first compartment and the second compartment are open and the batteries therein can be removed; and the first compartment being separate from the second compartment when the first compartment and the second compartment are open;

wherein the batteries include a cylindrical housing and have a first end, a second end and an axis along a center of the cylindrical housing; and wherein a first one of the first batteries in the first compartment has its axis co-linear with the axis of a second one of the second batteries in the second compartment when the backing is in the first position.

25. The package of claim 24, wherein:

the first compartment includes a latch mechanism for latching the first compartment onto the second compartment to maintain the backing in the first position.

26. The package of claim 24, wherein:

the first compartment includes a holding portion and a flap extending from the holding portion, the flap including the latch mechanism thereon.

27. The package of claim 24, wherein:

the second compartment includes a latch receiving mechanism for engaging the latch mechanism of the first compartment for latching the first compartment onto the second compartment to maintain the backing in the first position.

28. The package of claim 27, wherein:

the first compartment includes an opening tab for easily disengaging the latch mechanism from the latch receiving mechanism.

29. The package of claim 24, wherein:

the backing includes at least one fold line dividing the backing into a first area having the first compartment therein and a second area having the second compartment therein.

30. The package of claim 24, wherein:

the at least one fold line comprises two fold lines, the backing further including a spanning area between the first area and the second area.

31. The package of claim 24, wherein:

the backing comprises a flat panel when in the first position, with the flat panel having a first face and an opposite second face; and the first compartment and the second compartment extend from the first face.

32. The package of claim 25, wherein:

the latch mechanism releasibly latches the first compartment onto the second compartment to maintain the backing in the first position.

33. The package of claim 24, wherein:

the first compartment includes a wall having a plurality of arcuate portions, each arcuate portion configured to abut a side wall of the first batteries in the first compartment.

34. The package of claim 33, wherein:

the second compartment includes a wall having a plurality of arcuate portions, each arcuate portion of the wall of the second compartment configured to abut a side wall of the second batteries in the second compartment.

* * * * *